US011440066B2

(12) United States Patent
Kellermayr et al.

(10) Patent No.: US 11,440,066 B2
(45) Date of Patent: Sep. 13, 2022

(54) COLD ROLLING MILL WITH ALTERNATIVE FEED OF A STEEL STRIP OVER TWO DIFFERENT PATHS

(71) Applicant: Primetals Technologies Austria GmbH, Linz (AT)

(72) Inventors: Roland Kellermayr, St. Marien (AT); Konrad Krimpelstaetter, Gallneukirchen (AT); Alois Stadlbauer, Engerwitzdorf (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 0 days.

(21) Appl. No.: 17/602,316

(22) PCT Filed: Apr. 15, 2020

(86) PCT No.: PCT/EP2020/060504
§ 371 (c)(1),
(2) Date: Oct. 8, 2021

(87) PCT Pub. No.: WO2020/212372
PCT Pub. Date: Oct. 22, 2020

(65) Prior Publication Data

US 2022/0184676 A1 Jun. 16, 2022

(30) Foreign Application Priority Data

Apr. 18, 2019 (DE) ..... 10 2019 110 271.5

(51) Int. Cl.
*B21B 1/30* (2006.01)
*B21B 3/02* (2006.01)
(Continued)

(52) U.S. Cl.
CPC ..... *B21B 1/30* (2013.01); *B21B 3/02* (2013.01); *B21B 39/084* (2013.01);
(Continued)

(58) Field of Classification Search
CPC ..... B21B 2001/221; B21B 2001/225; B21B 2015/0064; B21B 37/50; B21B 39/084;
(Continued)

(56) References Cited

U.S. PATENT DOCUMENTS 6,357,273 B1 * 3/2002 Noe ..... B21B 37/48 72/227
6,722,002 B1 * 4/2004 Chang ..... B21B 3/00 148/426
(Continued)

FOREIGN PATENT DOCUMENTS

DE 10 2009 052 779 A1 5/2011
DE 10 2010 047 938 A1 7/2011
(Continued)

OTHER PUBLICATIONS

International Search Report dated Jul. 28, 2020 in corresponding PCT International Application No. PCT/EP2020/060504.
(Continued)

*Primary Examiner* — Shelley M Self
*Assistant Examiner* — Katie L. Parr
(74) *Attorney, Agent, or Firm* — Ostrolenk Faber LLP

(57) ABSTRACT

A first steel strip and a second steel strip (7) are rolled in succession in at least one roll stand (1) of a cold rolling mill. A rolling pause, in which no steel strip is rolled, is provided between the rolling of the first and the second steel strip (7). The first steel strip is fed over a first path starting from a first pay-off reel (2), and the second steel strip (7) is fed over a second path starting from the first pay-off reel (2), or from a second pay-off reel different from the first pay-off reel (2). The first steel strip is not heated as it is fed to the rolling mill (1), whereas, by contrast, the second steel strip (7) is heated. The second path is longer than the first path.

10 Claims, 5 Drawing Sheets

(51) Int. Cl.

| | |
|---|---|
| ***B21B 39/08*** | (2006.01) |
| ***B21B 45/00*** | (2006.01) |
| ***B21B 1/22*** | (2006.01) |
| ***B21B 15/00*** | (2006.01) |

(52) U.S. Cl.
CPC ..... *B21B 45/004* (2013.01); *B21B 2001/221* (2013.01); *B21B 2015/0064* (2013.01); *B21B 2273/14* (2013.01)

(58) Field of Classification Search
CPC ..... B21B 41/00; B21B 41/08; B21B 41/10; B21B 45/00
See application file for complete search history.

(56) References Cited

U.S. PATENT DOCUMENTS

| | | | | |
|---|---|---|---|---|
| 7,037,453 | B2 * | 5/2006 | Ament | B22F 7/04 264/46.5 |
| 10,207,303 | B2 | 2/2019 | Ueno et al. | |
| 2015/0013845 | A1 * | 1/2015 | Georgeou | B21B 1/466 148/309 |
| 2016/0016212 | A1 | 1/2016 | Charre et al. | |
| 2017/0002439 | A1 * | 1/2017 | Benedetti | B21B 45/004 72/41 |

FOREIGN PATENT DOCUMENTS

| | | | | |
|---|---|---|---|---|
| DE | 102010047938 | A1 * | 7/2011 | B21B 3/00 |
| EP | 3 097 990 | A1 | 11/2016 | |
| JP | H0760303 | A * | 8/1993 | B21B 3/00 |

OTHER PUBLICATIONS

Written Opinion dated Jul. 28, 2020 in corresponding PCT International Application No. PCT/EP2020/060504.

* cited by examiner

COLD ROLLING MILL WITH ALTERNATIVE FEED OF A STEEL STRIP OVER TWO DIFFERENT PATHS

CROSS-REFERENCE TO RELATED APPLICATIONS

The present application is a 35 U.S.C. §§ 371 national phase conversion of PCT/EP2020/060504, filed Apr. 15, 2020, the contents of which are incorporated herein by reference, which claims priority of German Patent Application No. 10 2019 110 271.5 filed Apr. 18, 2019, the contents of which are incorporated by reference herein. The PCT International Application was published in the German language.

FIELD OF TECHNOLOGY

The present invention is based on a method for operating a cold rolling mill,

- wherein a first steel strip and a second steel strip are rolled in at least one roll stand of the cold rolling mill,
- wherein there is a pause in rolling, in which no steel strip is rolled, between the rolling of the first steel strip and the rolling of the second steel strip,
- wherein starting from a first uncoiling reel, the first steel strip is fed to the roll stand via a first path and is not heated while it is being fed to the roll stand,
- wherein starting from the first uncoiling reel, the second steel strip is fed to the roll stand via a second path.

The present invention is furthermore based on a cold rolling mill,

- wherein the cold rolling mill has a roll stand, which rolls a first steel strip immediately after the first steel strip has been uncoiled from a first uncoiling reel and a second steel strip is rolled immediately after the second steel strip has been uncoiled from the first uncoiling reel,
- wherein starting from the first uncoiling reel, the cold rolling mill has a first path, via which the first steel strip, can be fed to the roll stand,
- wherein no heating device, by means of which the first steel strip can be heated, is arranged in the first path, causing the first steel strip to be fed to the roll stand at that temperature of the first steel strip at which it is uncoiled from the first uncoiling reel,
- wherein the cold rolling mill has a second path, via which the second steel strip, starting from the first uncoiling reel, can be fed to the roll stand.

PRIOR ART

Magnetic steel sheet is a relatively thin steel. To improve the magnetic properties, that steel sheet may contain a relatively high proportion of silicon. In the production of steel sheets of this type, during cold rolling, there is a risk of strip cracks. The strip cracks, in turn, result from edge cracks, which can occur during cold rolling. Causes of the edge cracks include brittleness and fragility of the steel strip, which is still unrolled, caused by the cold rolling, in conjunction with loads to which the steel strip is subjected during cold rolling.

The brittleness and fragility of steel sheet having a high proportion of silicon (or else a high proportion of aluminum) depends largely on the temperature of the steel strip during cold rolling. In particular, it is known that a higher temperature leads to a significant decrease in brittleness and thus to a reduction in the risk of strip cracks.

During cold rolling, the temperature of the steel strip increases due to the forming work introduced into the steel strip. During the first pass of the cold rolling, however, the temperature of the steel strip often only corresponds to the ambient temperature, i.e. typically approx. 20° C.

In continuous tandem mill trains (for example of the PLTCM=Pickling Line Tandem Cold Mill or CTCM=Continuous Tandem Cold Mill types), it is known to arrange a strip-heating device in the form of an induction heater in a region upstream of the first roll stand of the continuous tandem mill train. The temperature of the steel strip is raised by the strip-heating device, for example in a range of from approx. 80° C. to approx. 160° C. This significantly reduces the brittleness of the steel strip, so that there is a considerably lower risk of strip cracks. Furthermore, this makes it possible to perform the rolling at a higher rolling speed, causing the productivity of the continuous tandem mill train to increase.

The induction heater requires considerable structural space. However, the system layout of a continuous tandem mill train makes generally readily possible to arrange a corresponding induction heater upstream of the first roll stand of the continuous tandem mill train.

However, in a discontinuous tandem cold rolling mill train or a cold-rolling reversing stand, such structural space is often not available. In particular, these systems usually have a very compact structure in order to keep the off-gauge length as small as possible, i.e. that strip length which lies outside the desired tolerances at the head region and foot region of the cold-rolled steel strip and therefore has to be scrapped.

It is conceivable to also provide an induction heater of this type in the inlet region in the case of a discontinuous tandem cold rolling mill train or in the case of a cold-rolling reversing stand. However, this would necessitate arranging the uncoiling reel, from which the steel strip is uncoiled before the first rolling pass of the cold rolling, correspondingly far away from the roll stand which carries out the first rolling pass of the cold rolling. In addition to the conversion work, this would result in the off-gauge length of all cold-rolled steel strips, even those steel strips which can be cold rolled and without prior heating, being correspondingly enlarged, and thereby reducing the output and increasing the amount of scrap which arises.

SUMMARY OF THE INVENTION

The object of the present invention is to provide options which make it possible to roll brittle and fragile steel strips in a discontinuous cold rolling mill without the risk or at least with a significantly reduced risk of strip cracks developing, and nevertheless to keep the off-gauge length small, at least for steel strips that are not subject to strip cracks even without prior heating.

The object is achieved by a method for operating a cold rolling mill, wherein the method has the features of the operating method disclosed herein.

According to the invention, the second steel strip is heated while it is being fed to the roll stand, wherein the second path is also longer than the first path. The uncoiling reel from which the second steel strip is uncoiled may be the first uncoiling reel. As an alternative, it may be a second uncoiling reel which is different from the first uncoiling reel.

The second steel strip is preferably heated by an induction heater. Heating of this type is simple, effective, cost-effective, reliable and robust. It is preferably provided that starting from the first or the second uncoiling reel, the second steel strip is initially moved toward the roll stand, but the feeding toward the roll stand is ended before a head of the second steel strip arrives at the roll stand, the heating device is then placed against the second steel strip, so that as viewed in the transport direction of the second steel strip, the heating device is located at a portion of the second steel strip that has already been uncoiled at this time, and only then is the feeding of the second steel strip toward the roll stand continued, such that the head of the strip arrives at the roll stand and is taken up by the roll stand.

This makes threading of the second steel strip possible in a simple manner without the risk of the heating device being damaged by the second steel strip.

The second steel strip is preferably moved somewhat away from the roll stand between the placement of the heating device against the second steel strip and the subsequent continuation of the feeding of the second steel strip toward the roll stand, such that the head of the second steel strip stops at the outlet of the heating device. This makes it possible to preheat the entire second steel strip, so that the starting region of the second steel strip, directly adjoining the head of the strip is rolled already in a preheated state.

The object is also achieved by a cold rolling mill having the features disclosed herein.

According to the invention, a cold rolling mill of the type mentioned at the beginning is configured so that a heating device, by which the second steel strip can be heated, is arranged in the second path. This causes the second steel strip to be fed to the roll stand at a temperature which is higher than that temperature of the second steel strip at which the second strip is uncoiled from the first or second uncoiling reel, and the second path is longer than the first path.

In the same way as performed by the method for operating the cold rolling mill, the uncoiling reel from which the second steel strip is uncoiled, may be alternatively the first uncoiling reel or a second uncoiling reel which is different from the first uncoiling reel.

A first possible configuration of the cold rolling mill provides that the second steel strip is uncoiled from the first uncoiling reel;

the first uncoiling reel is arranged on a movable platform, which can be positioned at least in a first position or in a second position. The first uncoiling reel is arranged closer to the roll stand in the first position of the platform than in the second position of the platform. As a result, the first path extends from the first uncoiling reel to the roll stand, while the platform is in the first position, and the second path extends from the first uncoiling reel to the roll stand, while the platform is in the second position, and so that at least whenever the movable platform is in the second position, the heating device can be placed against the second steel strip parallel to the second steel strip, but transversely in relation to a transport direction of the second steel strip from the first uncoiling reel to the roll stand, or the heating device can be placed against the second steel strip orthogonally in relation to the second steel strip.

As an alternative, the second steel strip is uncoiled from the first uncoiling reel, a loop lifter is arranged between the first uncoiling reel and the roll stand. The first steel strip passes without deflection in a first positioning of the loop lifter. The second steel strip passes in a second positioning of the loop lifter by forming a loop, so that the first path extends from the first uncoiling reel to the roll stand without forming a loop and the second path extends from the first uncoiling reel to the roll stand with formation of the loop, at least whenever the loop lifter is in the second position, the heating device can be placed against the second steel strip in the region of the loop parallel to the second steel strip, but transversely in relation to a transport direction of the second steel strip in the region of the loop.

As an alternative, it is possible, that the second steel strip is uncoiled from the second uncoiling reel, and that a driver device is arranged upstream of the roll stand, such that the first path extends via the driver device from the first uncoiling reel to the roll stand and the second path extends from the second uncoiling reel to the roll stand via the driver device, and that the heating device is arranged between the second uncoiling reel and the driver device.

In the last-mentioned embodiment, the heating device can preferably be placed against the second steel strip and parallel to the second steel strip, but transversely in relation to a transport direction of the second steel strip from the second uncoiling reel to the driver device, or can be placed against the second steel strip orthogonally in relation to the second steel strip.

Irrespective of the rest of the configuration of the cold rolling mill, the heating device is preferably in the form of an induction heater. This configuration of the heating device is simple, effective, cost-effective, reliable and robust.

BRIEF DESCRIPTION OF THE DRAWINGS

The characteristics, features and advantages of this invention that are described above and the manner in which they are achieved become clearer and more distinctly comprehensible in connection with the following description of the exemplary embodiments, which are explained in more detail in conjunction with the drawings, in which, in a schematic depiction.

DESCRIPTION OF THE EMBODIMENTS

A first embodiment of the present invention will first be explained below in conjunction with FIGS. 1 to 3.

Figure 1:
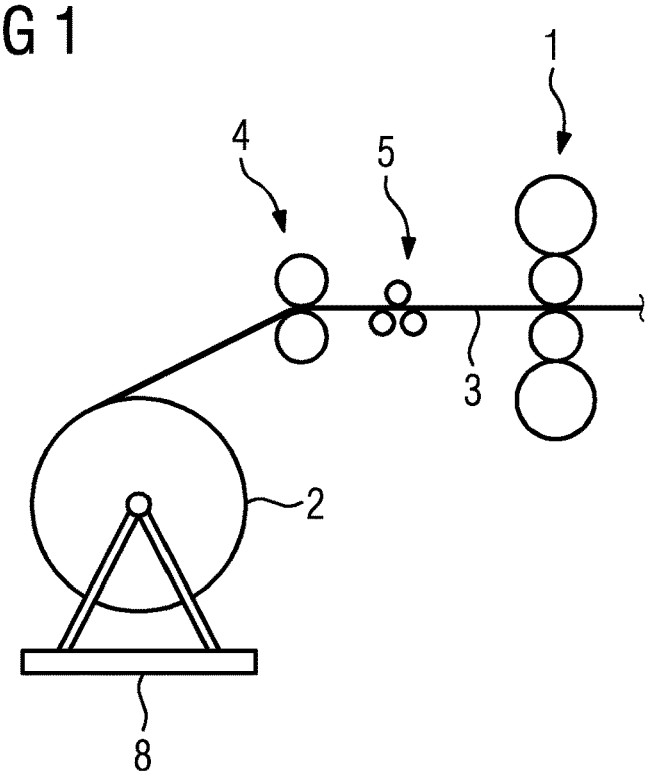
FIG. 1 shows a cold rolling mill during the rolling of a first steel strip.

According to FIG. 1, a cold rolling mill has a roll stand 1 and a first uncoiling reel 2. A first steel strip 3 is uncoiled by means of the first uncoiling reel 2. The first steel strip 3 is fed to the roll stand 1, starting from the first uncoiling reel 2 via a first path and is cold rolled in the roll stand 1 immediately after the uncoiling operation. The expression "immediately after the uncoiling operation" is intended to mean that no other rolling pass takes place between the uncoiling of the first steel strip 3 and the rolling pass performed by the roll stand 1. The rolling pass performed by the roll stand 1 is therefore the first rolling pass of the cold rolling operation. However, it is possible for other devices to be present, through which devices the first steel strip 3 passes between the uncoiling from the first uncoiling reel 2 and the arrival at the roll stand 1. In accordance with the illustration in FIG. 1, examples of such devices are a deflecting-roller pair 4 and a straightening driver 5.

It is possible for the roll stand 1 to be the only roll stand of the cold rolling mill. In this case, the steel strip 3 is generally reversingly rolled in the roll stand 1. As an alternative, there may be further roll stands, not illustrated in FIG. 1, arranged downstream of the roll stand 1. Whether one configuration or the other is implemented is of secondary importance in the context of the present invention. This is because it is the first pass of the cold rolling that is important in the context of the present invention.

On the path from the first uncoiling reel 2 to the roll stand 1, during the feeding to the roll stand 1, the first steel strip 3 is not heated. For this reason, a heating device 6 (see FIGS. 2 and 3), which is introduced yet later, is also not illustrated in FIG. 1. In particular, it is also not arranged in the first path in this operating phase of the cold rolling mill. The first steel strip 3 is thus fed to the roll stand 1 at that temperature of the first steel strip 3 at which it is uncoiled from the first uncoiling reel 2.

After the first steel strip 3 has been rolled, there is initially a usually relatively short pause in rolling. During the pause in rolling, in accordance with the illustration in FIG. 2, no steel strip is rolled in the roll stand 1, that is, neither the first steel strip 3 nor a second steel strip 7 (see FIG. 3). However, after the pause in rolling, the second steel strip 7 is rolled. The corresponding state of the cold rolling mill is illustrated in FIG. 3.

In order to cold roll the second steel strip 7, the second steel strip 7 is likewise uncoiled from the first uncoiling reel 2 and then fed to the roll stand 1. The feeding takes place starting from the first uncoiling reel 2, but via a second path. The second steel strip 7 is also cold rolled in the roll stand 1 immediately after the uncoiling operation. The expression "immediately after the uncoiling operation" is intended to mean, as before, that no other rolling pass takes place between the uncoiling of the second steel strip 7 and the rolling pass performed by the roll stand 1. The rolling pass performed by the roll stand 1 is therefore the first rolling pass of the cold rolling operation. However, it is also possible for other devices to be present, through which devices the second steel strip 7 passes between the uncoiling from the first uncoiling reel 2 and the arrival at the roll stand 1. Examples of such devices are, as before, a deflecting-roller pair 4 and a straightening driver 5.

In contrast to the first steel strip 3, however, the second steel strip 7 is heated on the path from the first uncoiling reel 2 to the roll stand 1, while it is being fed to the roll stand 1. For this reason, the heating device 6 is arranged in the second path. The second steel strip 7 is thus fed to the roll stand 1 at a temperature which is higher than that temperature of the second steel strip 7 at which the second steel strip is uncoiled from the first uncoiling reel 2.

Figure 2:
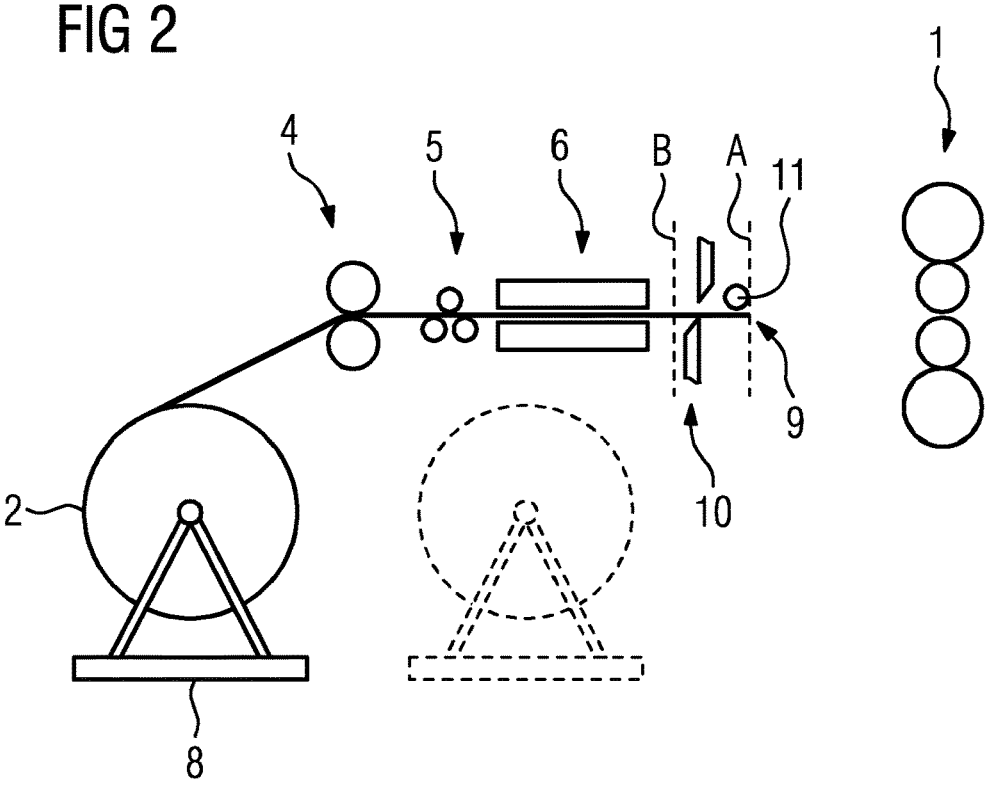
FIG. 2 shows the cold rolling mill from FIG. 1 during a pause in rolling between the rolling of the first steel strip and the rolling of a second steel strip.
Figure 3:
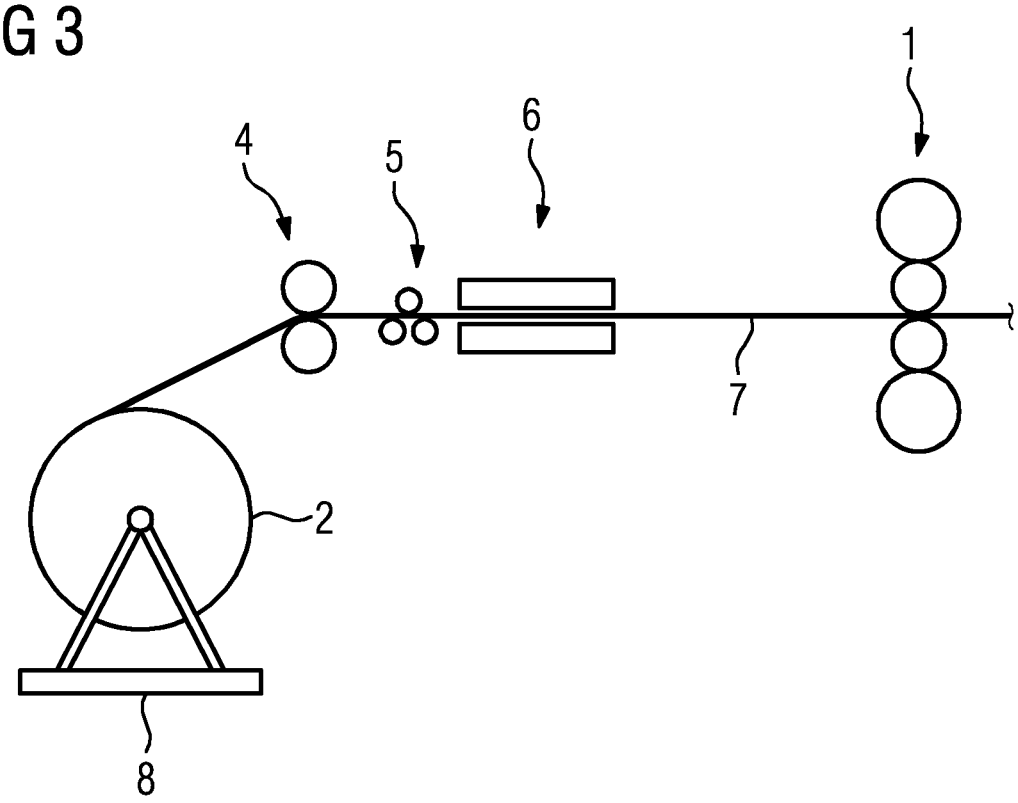
FIG. 3 shows the cold rolling mill from FIG. 1 during the rolling of the second steel strip.

In order to provide the necessary space for the heating device 6, the first uncoiling reel 2 is arranged on a movable platform 8 in the context of the configuration in FIGS. 1 to 3. For example, the movable platform 8 may be arranged on rails (not illustrated). The movable platform 8 can be positioned at least in a first position (FIG. 1, illustrated in dashed lines on the right in FIG. 2) and a second position (illustrated in solid lines on the left in FIG. 2, and in FIG. 3). The first uncoiling reel 2 is thus arranged closer to the roll stand 1 in the first position of the platform 8 than in the second position of the platform 8. As a result, the second path, like the first path, extends from the first uncoiling reel 2 to the roll stand 1. However, the second path is longer than the first path, since the first uncoiling reel 2 is further away from the roll stand 1 in the second position of the platform 8 than in the first position of the platform 8.

In the context of the configuration according to FIGS. 1 to 3, the heating device 6 can be placed against the second steel strip 7 from a deactivated position. The placing-on operation is preferably carried out in a direction which runs parallel to the second steel strip 7, but is directed transversely in relation to a transport direction. The transport direction is that direction in which the second steel strip 7 is conveyed from the first uncoiling reel 2 to the roll stand 1. As an alternative, it would be possible to place the heating device 6 against the second steel strip 7 from above and/or below.

The heating device 6 may be designed as required. It is preferably in the form of an induction heater.

In specific cases, it may be possible for the heating device 6 to be able to be placed against the second steel strip 7 regardless of whether the movable platform 8 is in the first or in the second position. It is at least the case, however, that it can be placed against the steel strip when the movable platform 8 is in the second position.

In order to roll the second steel strip 7, in accordance with the illustration in FIG. 3, the second steel strip 7 is firstly moved, starting from the first uncoiling reel 2, toward the roll stand 1. However, the feeding toward the roll stand 1 is ended before a head 9 of the second steel strip 7 arrives at the roll stand 1. For example, the feeding may be ended when the head 9 of the strip arrives at a point designated by A in FIG. 2. After the second steel strip 7 has stopped, the heating device 6 is then placed against the second steel strip 7. After being placed against the second steel strip, the heating device 6, as viewed in the transport direction of the second steel strip 7, is thus located at a portion of the second steel strip 7 that has already been uncoiled at this time. For example, the heating device 6 may surround this portion given a corresponding configuration. Only after the heating device 6 has been placed against the second steel strip 7 does the feeding of the second steel strip 7 toward the roll stand 1 continue. This continuation takes place until the head 9 of the strip arrives at the roll stand 1 and is taken up by the roll stand 1. After this, the rolling of the second steel strip 7 begins.

After the heating device 6 has been placed against the second steel strip 7, the further feeding to the roll stand 1 preferably does not take place immediately. Rather, firstly, the second steel strip 7 is preferably moved somewhat away from the roll stand 1. The movement away is preferably far enough that the head 9 of the second steel strip 7 stops at the outlet of the heating device 6, approximately at a point designated by B in FIG. 2.

In accordance with the illustration in FIG. 2, it is also possible for a shearing means 10 to be arranged between the two points designated by A and B. In this case, the head 9 of the strip may be cropped before the strip is moved away. Furthermore, it is possible for a hold-down roller 11 to be arranged between the two points designated by A and B, if the shearing means 10 is present, between the shearing means and the point designated by A. The hold-down roller 11 can generally be placed against the second steel strip 7, for example by pivoting. The hold-down roller 11 makes it possible in particular to have the effect that the second steel strip 7 is precisely positioned when the heating device 6 is placed against it. In particular, any ski, such as a head 9 of a strip that is bent upward, can in this way be suppressed while the heating device 6 is being placed against the second steel strip 7. This significantly reduces the risk of damage to the heating device 6. The same applies if the intention is for the second steel strip 7 to have large unevennesses.

A second embodiment of the present invention will now be explained in conjunction with FIGS. 4 to 6.

Figure 4:
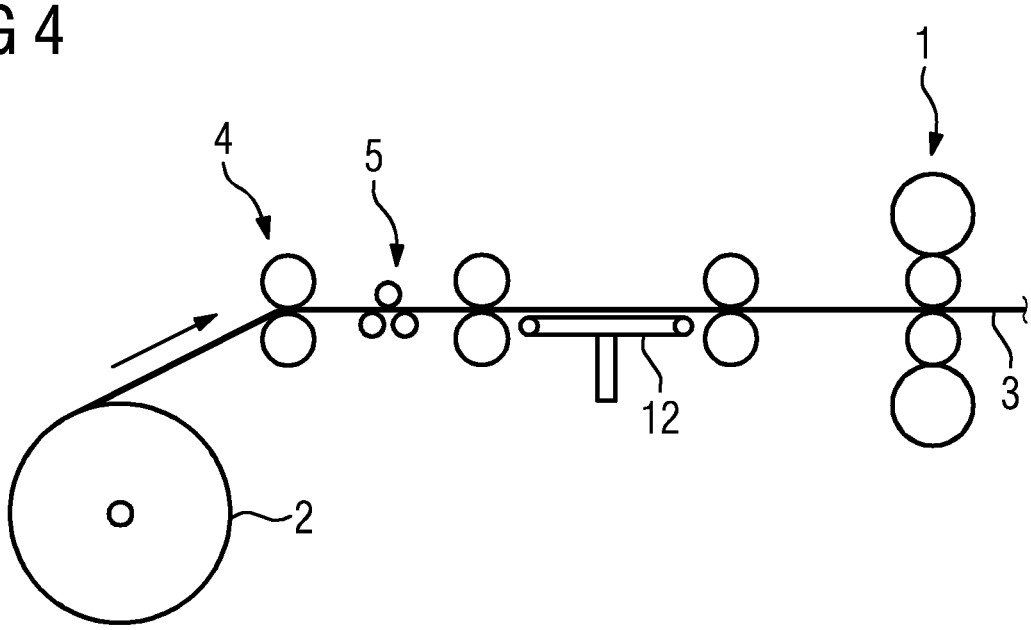
FIG. 4 shows a further cold rolling mill during the rolling of a first steel strip.

According to FIG. 4, a cold rolling mill, as described before, has a roll stand 1 and a first uncoiling reel 2. A first steel strip 3 is uncoiled by means of the first uncoiling reel 2. Starting from the first uncoiling reel 2, the first steel strip 3 is fed to the roll stand 1 via a first path and is cold rolled in the roll stand 1 immediately after the uncoiling operation. The expression "immediately after the uncoiling operation" is intended to mean, as before, that no other rolling pass takes place between the uncoiling of the first steel strip 3 and the rolling pass performed by the roll stand 1.

As before, it is possible for the roll stand 1 to be the only roll stand of the cold rolling mill. As an alternative, there may be further roll stands, not illustrated in FIG. 4, arranged downstream of the roll stand 1.

During the feeding to the roll stand 1, on the path from the first uncoiling reel 2 to the roll stand 1, the first steel strip 3 is not heated as before. For this reason, the heating device 6 (see FIGS. 5 and 6) is also not illustrated in FIG. 4. In particular, the feeding device is also not arranged in the first path in this operating phase of the cold rolling mill. The first steel strip 3 is thus fed to the roll stand 1, as before, at that temperature of the first steel strip 3 at which it is uncoiled from the first uncoiling reel 2.

After the first steel strip 3 has been rolled, there is, as before, initially a usually relatively short pause in rolling. In accordance with FIG. 5, during the pause in rolling, no steel strip is rolled in the roll stand 1, that is neither the first steel strip 3 nor the second steel strip 7 (see FIG. 6). However, after the pause in rolling, the second steel strip 7 is rolled. The corresponding state of the cold rolling mill is illustrated in FIG. 6.

In order to cold roll the second steel strip 7, as before, the second steel strip 7 is likewise uncoiled from the first uncoiling reel 2 and then fed to the roll stand 1. Starting from the first uncoiling reel 2, the feeding takes place via a second path. The second steel strip 7 is also cold rolled in the roll stand 1 immediately after the uncoiling operation. The expression "immediately after the uncoiling operation" is intended, as before, to mean that no other rolling pass takes place between the uncoiling of the second steel strip 7 and the rolling pass performed by the roll stand 1. The rolling pass performed by the roll stand 1 is therefore the first rolling pass of the cold rolling operation.

In contrast to the first steel strip 3, however, as before, the second steel strip 7 is heated on the path from the first uncoiling reel 2 to the roll stand 1, while the second steel strip is being fed to the roll stand 1. For this reason, the heating device 6 is arranged in the second path. The second steel strip 7 is thus fed to the roll stand 1 at a temperature which is higher than that temperature of the second steel strip 7 at which it is uncoiled from the first uncoiling reel 2.

Figure 5:
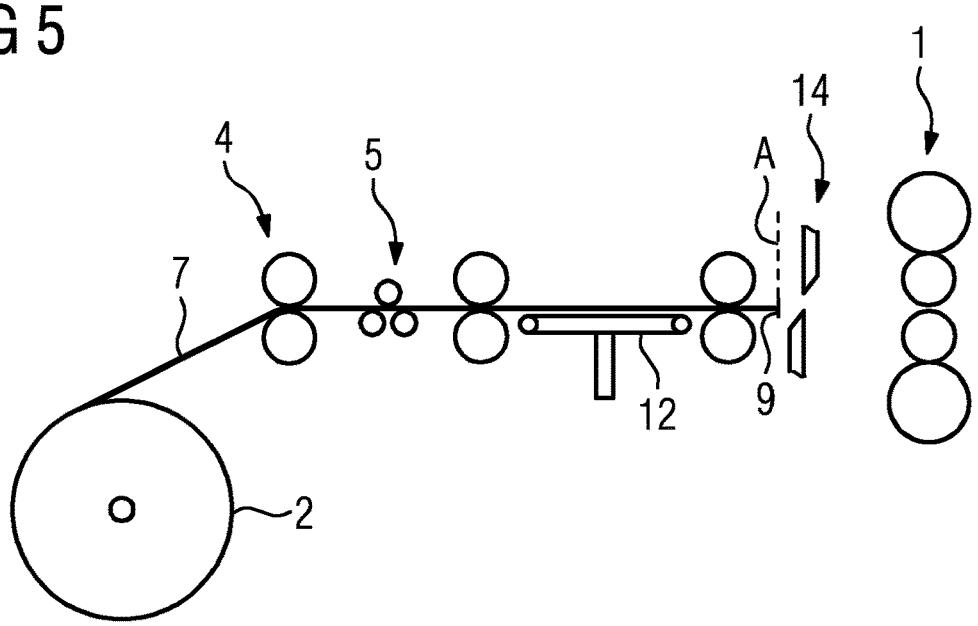
FIG. 5 shows the cold rolling mill from FIG. 4 during a pause in rolling between the rolling of the first steel strip and the rolling of a second steel strip.
Figure 6:
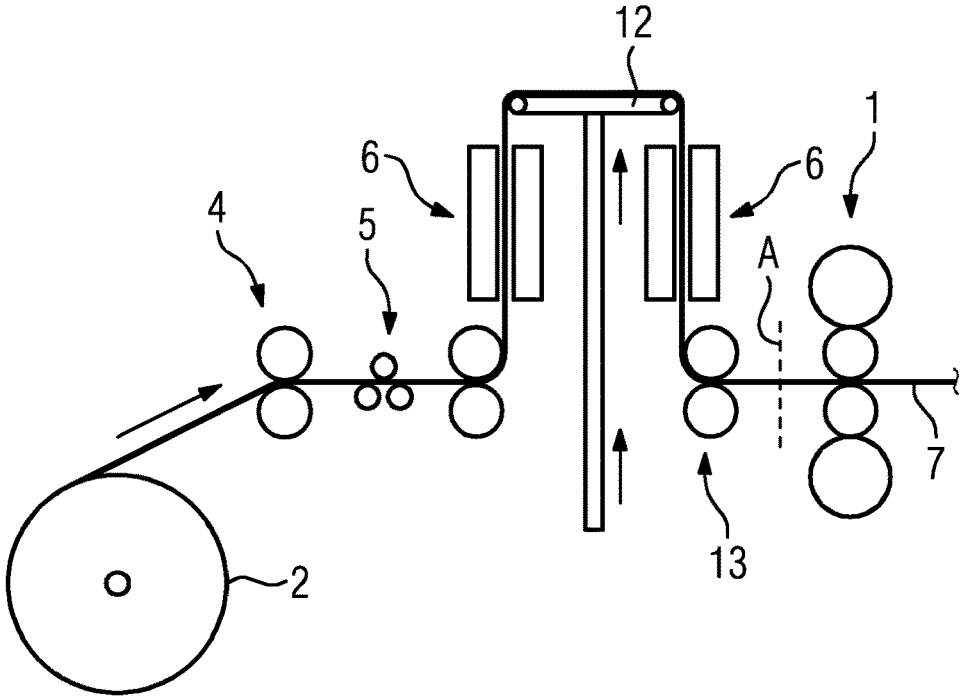
FIG. 6 shows the cold rolling mill from FIG. 4 during the rolling of the second steel strip.

In order to create the necessary space for the heating device 6, a loop lifter 12 is arranged between the first uncoiling reel 2 and the roll stand 1 in the context of the configuration of FIGS. 4 to 6. The loop lifter 12 can be positioned at least in a first position (FIG. 4, FIG. 5) and a second position (FIG. 6). In the first position, the first steel strip 3 passes through the loop lifter 12 without deflection and thus also without the formation of a loop. In the second positioning, the second steel strip 7 passes through the loop lifter 12 to form a loop. This means that the second path is longer than the first path.

In the context of the configuration according to FIGS. 4 to 6, the heating device 6 can be placed against the second steel strip 7 from a deactivated position. The placing-on operation is preferably carried out in a direction which runs parallel to the second steel strip 7, but is directed transversely in relation to a (local) transport direction of the second steel strip 7. The transport direction is that direction in which the second steel strip 7 is conveyed (locally) from the first uncoiling reel 2 to the roll stand 1. In particular, the second steel strip 7 can be conveyed essentially vertically in the region of the loop in accordance with the illustration in FIG. 6, and the heating device 6 can be placed against the second steel strip 7 essentially horizontally and parallel to the width direction of the second steel strip 7 in the region of the loop.

The heating device 6 may be designed as required. It is preferably in the form of an induction heater.

In the context of the configuration of the cold rolling mill according to FIGS. 4 to 6, the heating device 6 can be placed against the second steel strip 7 at least when the loop lifter 12 is in the second position. Usually, the heating device can be placed against said steel strip exclusively at this stage.

In accordance with the illustration in FIG. 6, in order to roll the second steel strip 7, the second steel strip 7 is firstly moved, starting from the first uncoiling reel 2, toward the roll stand 1. However, the feeding toward the roll stand 1 is ended before the head 9 of the second steel strip 7 arrives at the roll stand 1. For example, the feeding may be ended when the head 9 of the strip arrives at a point designated by A in FIG. 5. A driver device 13, which drives the second steel strip 7 (and also the first steel strip 3), is generally located shortly upstream of this point. When the head 9 of the second steel strip 7 arrives at the driver device 13, the loop lifter 12 is generally still in the first position. After the driver device 13 has engaged the head 9 of the strip, the loop lifter 12 is transferred from the first position to the second position. The second steel strip 7 is uncoiled to the extent required to form the loop. When the loop lifter 12 has arrived at the second position, the heating device 6 is then placed against the second steel strip 7. After being placed against the second steel strip, the heating device 6, as viewed in the transport direction of the second steel strip 7, is thus located at a portion of the second steel strip 7 that has already been uncoiled at this time. Only after the heating device 6 has been placed against the second steel strip 7 does the feeding of the second steel strip 7 toward the roll stand 1 continue.

This continuation takes place until the head 9 of the strip arrives at the roll stand 1 and is taken up by the roll stand 1. After this, the rolling of the second steel strip 7 begins.

In accordance with the illustration in FIG. 5, it is also possible for a shearing means 14 to be arranged between the driver device 13 and the roll stand 1. In this case, the head 9 of the strip may be cropped before the strip is fed to the roll stand 1.

Figure 7:
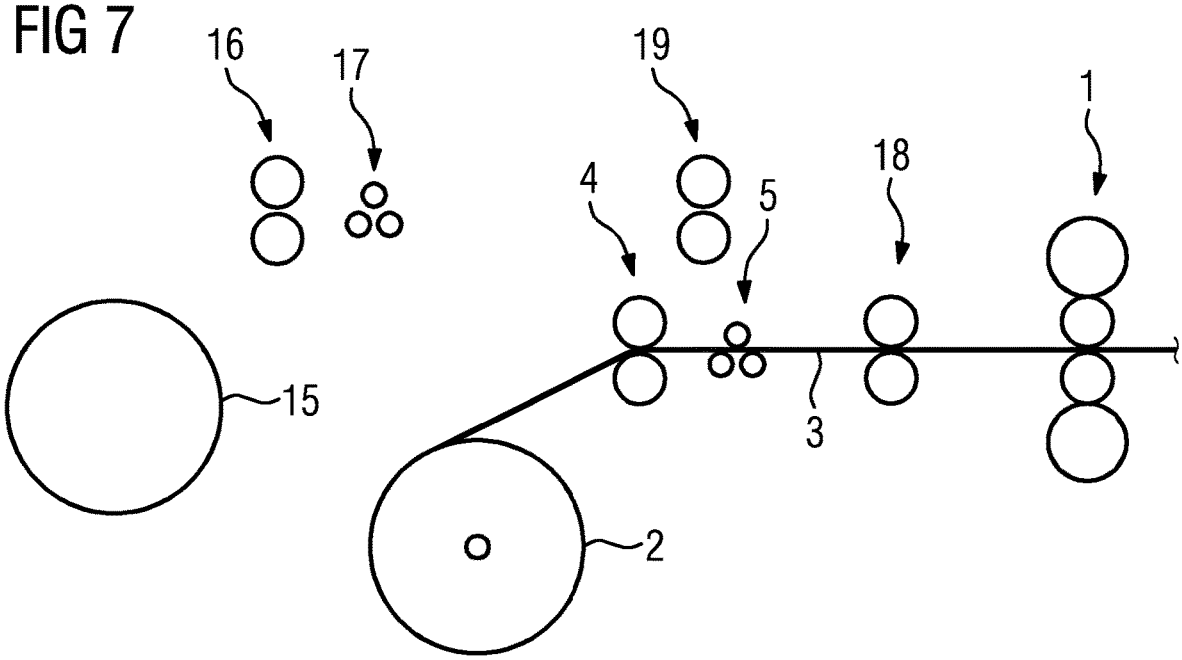
FIG. 7 shows a further cold rolling mill during the rolling of a first steel strip.
Figure 8:
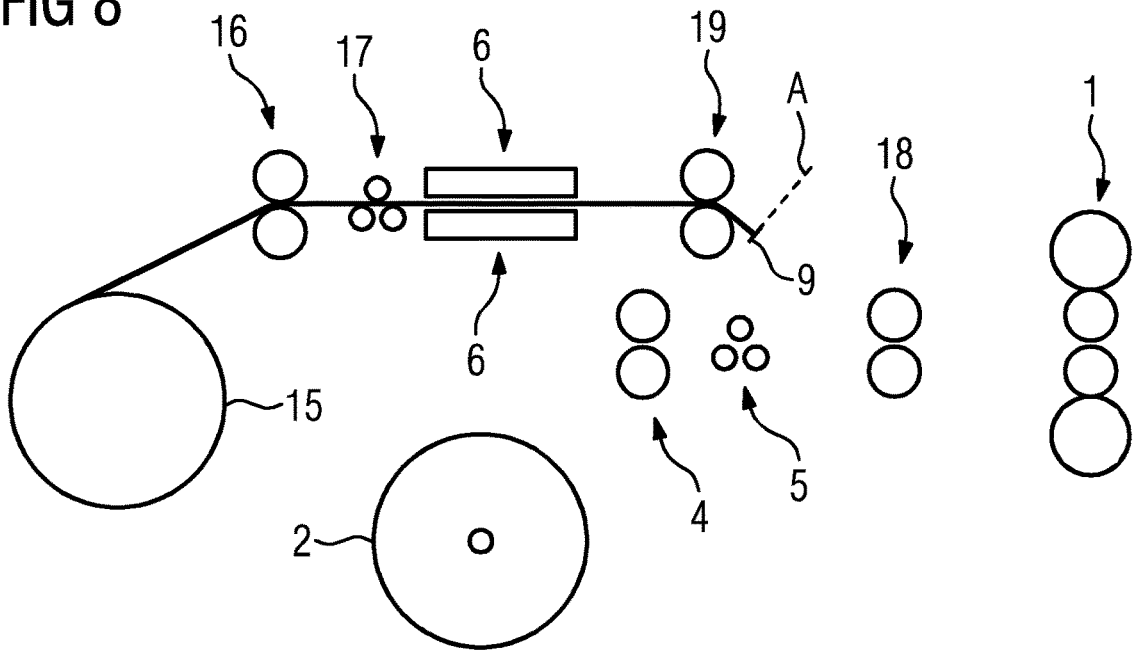
FIG. 8 shows the cold rolling mill from FIG. 7 during a pause in rolling between the rolling of the first steel strip and the rolling of a second steel strip.
Figure 9:
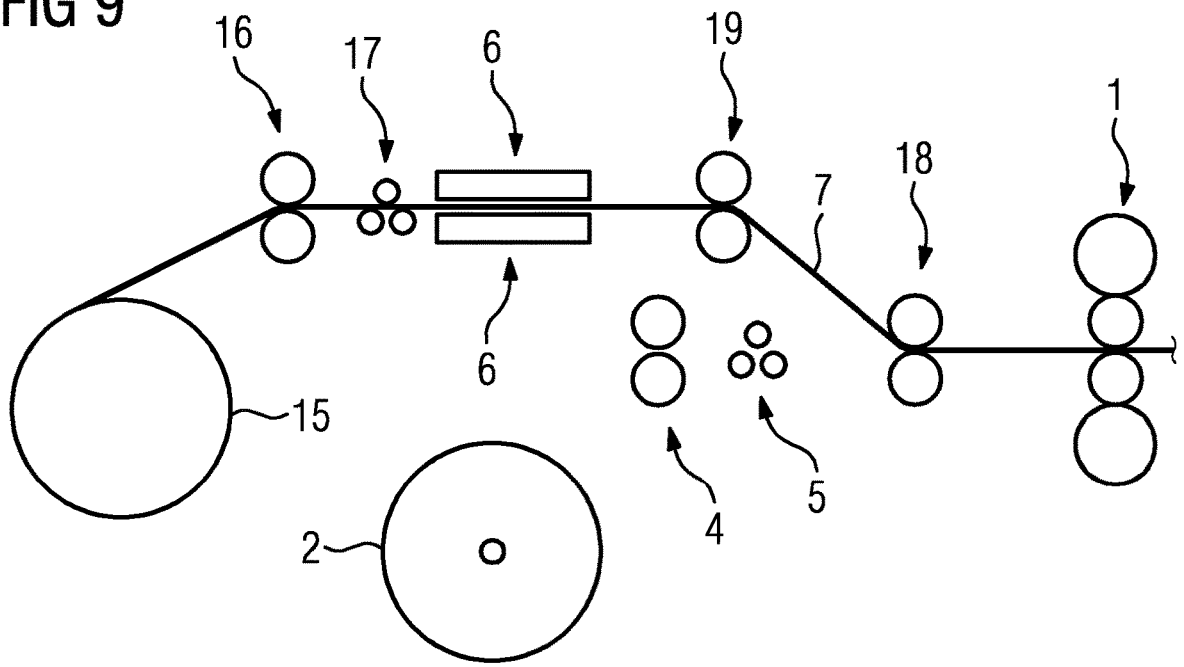
FIG. 9 shows the cold rolling mill from FIG. 7 during the rolling of the second steel strip.

A third embodiment of the present invention is now explained in conjunction with FIGS. 7 to 9.

According to FIG. 7, as before, a cold rolling mill has a roll stand 1 and a first uncoiling reel 2. A first steel strip 3 is uncoiled by means of the first uncoiling reel 2. Starting from the first uncoiling reel 2, the first steel strip 3 is fed to the roll stand 1 via a first path and is cold rolled in the roll stand 1 immediately after the uncoiling operation. As before, the expression "immediately after the uncoiling operation" is intended to mean that no other rolling pass takes place between the uncoiling of the first steel strip 3 and the rolling pass performed by the roll stand 1. However, in accordance with the illustration in FIGS. 7 to 9, it is possible for other devices to be present, through which devices the first steel strip 3 passes between the uncoiling from the first uncoiling reel 2 and the arrival at the roll stand 1. In a manner analogous to the configuration according to FIGS. 1 to 3, examples of such devices are a deflecting-roller pair 4 and a straightening driver 5.

As before, it is again possible for the roll stand 1 to be the only roll stand of the cold rolling mill. As an alternative, there may be further roll stands, not illustrated in FIG. 7, arranged downstream of the roll stand 1.

On the path from the first uncoiling reel 2 to the roll stand 1, during the feeding to the roll stand 1, as before, the first steel strip 3 is not heated. As before, the first steel strip 3 is thus fed to the roll stand 1, as before, at that temperature of the first steel strip 3 at which it is uncoiled from the first uncoiling reel 2.

After the first steel strip 3 has been rolled, as before, there is, as before, initially a usually relatively short pause in rolling. The corresponding state is illustrated in FIG. 8. During the pause in rolling, no steel strip is rolled in the roll stand 1, neither the first steel strip 3 nor the second steel strip 7 (see FIG. 9). However, after the pause in rolling, the second steel strip 7 is rolled in accordance with the illustration in FIG. 9.

In order to cold roll the second steel strip 7, the second steel strip 7 is uncoiled from a second uncoiling reel 15 and then is fed to the roll stand 1. The second uncoiling reel 15 is an uncoiling reel which is different than the first uncoiling reel 2. Starting from the second uncoiling reel 15, the feeding takes place via a second path. The second steel strip 7 is also cold rolled in the roll stand 1 immediately after the uncoiling operation. As before, the expression "immediately after the uncoiling operation" is intended to mean that no other rolling pass takes place between the uncoiling of the second steel strip 7 and the rolling pass performed by the roll stand 1. The rolling pass performed by the roll stand 1 is therefore the first rolling pass of the cold rolling operation. However, in accordance with the illustration in FIGS. 7 to 9, it is possible for other devices to be present, through which devices the second steel strip 7 passes between the uncoiling from the second uncoiling reel 15 and the arrival at the roll stand 1. In accordance with the illustration in FIGS. 7 to 9, examples of such devices are a deflecting-roller pair 16 and a straightening driver 17.

In contrast to the first steel strip 3, the second steel strip 7, as before, is heated on the path from the second uncoiling reel 15 to the roll stand 1, while it is being fed to the roll stand 1. For this reason, the heating device 6 is arranged in the second path. The second steel strip 7 is thus fed to the roll stand 1 at a temperature which is higher than that temperature of the second steel strip 7 at which it is uncoiled from the second uncoiling reel 15.

In order to be able to feed the first steel strip 3 starting from the first uncoiling reel 2 as well as the second steel strip 7, starting from the second uncoiling reel 15 to the roll stand 1, a driver device 18 is arranged upstream of the roll stand 1. Both paths thus extend from the respective uncoiling reel 2, 15 via the driver device 18 to the roll stand 1.

Furthermore, in order to be able to keep the spacing between the first uncoiling reel 2 and the roll stand 1 as small as possible, the heating device 6 is arranged between the second uncoiling reel 15 and the driver device 18 in the context of the configuration of FIGS. 7 to 9. Owing to the presence of the heating device 6, the spacing between the second uncoiling reel 15 and the driver device 18 is furthermore greater than the spacing between the first uncoiling reel 2 and the driver device 18. Accordingly, the second path from the second uncoiling reel 15 to the roll stand 1) is also larger than the first path from the first uncoiling reel 2 to the roll stand 1.

In the context of the configuration according to FIGS. 7 to 9, it is possible for the heating device 6 to be arranged in a stationary manner. Preferably, however, it is in this configuration that the heating device 6 can be placed against the second steel strip 7 from a deactivated position. The placing-on operation is preferably carried out in a direction which runs parallel to the second steel strip 7, but is directed transversely in relation to a local transport direction of the second steel strip 7. The transport direction is that direction in which the second steel strip 7 in the region of the heating device 6 is conveyed locally from the second uncoiling reel 15 to the driver device 18.

The heating device 6 may be designed as required. It is preferably in the form of an induction heater.

In accordance with the illustration in FIG. 9, in order to roll the second steel strip, the second steel strip 7 is firstly moved, starting from the second uncoiling reel 15, toward the roll stand 1. However, the feeding toward the roll stand 1 is ended before the head 9 of the second steel strip 7 arrives at the roll stand 1. For example, the feeding may be ended when the head 9 of the strip arrives at a point designated by A in FIG. 8. A deflecting-roller pair 19, which drives the second steel strip 7, but generally not the first steel strip 3, is generally located shortly upstream of this point. The deflecting-roller pair 19 is therefore located upstream of the driver device 18. After the deflecting-roller pair 19 has engaged the head 9 of the strip, if appropriate, the head 9 of the strip may be cropped shortly upstream or shortly downstream of the deflecting-roller pair 19 by a shearing means, not illustrated. In this state, with or without and, if appropriate, before or after the cropping of the head 9 of the strip, the heating device 6 is placed against the second steel strip 7. After being placed against the second steel strip, as viewed in the transport direction of the second steel strip 7, the heating device 6 is thus located at a portion of the second steel strip 7 that has already been uncoiled at this time. Only after the heating device 6 has been placed against the second steel strip 7 does the feeding of the second steel strip 7 toward the roll stand 1 continue. This continuation takes place until the head 9 of the strip arrives at the roll stand 1 and is taken up by the roll stand 1. After this, the rolling of the second steel strip 7 begins.

Various configurations of the principles explained above are also possible. For example, in the context of the last-explained configuration, it is possible to lift off the upper roller of the deflecting-roller pair 19 from the second steel strip 7 as soon as the driver device 18 engages the second steel strip 7. The upper roller of the deflecting-roller pair 19 may also assume the function of a hold-down roller at the same time. Furthermore, the order in which the first and the second steel strips 3, 7 are rolled is of secondary importance in all configurations of the present invention. It is therefore also the case that the second steel strip 7 may be rolled first, and only then, after a pause in rolling, may the first steel strip 3 be rolled.

The present invention has many advantages. In particular, steel strips which are relatively ductile in the cold state can be classified as first steel strips 3 and, also in the prior art, can be rolled with a very small off-gauge length. By contrast, steel strips which are brittle and fragile in the cold state, particularly magnetic steel sheet, can be classified as second steel strips 7. Therefore, these steel strips are heated in the roll stand 1 before the rolling. Although these steel strips therefore have a greater off-gauge length, they can be rolled reliably and without the risk of strip cracks. Because the heating device 6 is only placed against the second steel strip after the respective second steel strip 7 has passed through the region in which the heating device 6 is placed against the respective second steel strip 7, the heating device 6 is also reliably protected from damage when the respective second steel strip 7 is strongly curved or has a ski. In the case of the configuration according to FIGS. 7 to 9, further operation of the cold rolling mill is also possible in the event of a failure of one of the two uncoiling reels 2, 15. The invention may furthermore also be retrofitted to existing discontinuous cold rolling mills. The costs required to convert the respective cold rolling mill are relatively low.

Although the invention has been illustrated and described in more detail by the preferred exemplary embodiment, the invention is not limited by the examples disclosed, and other variations can be derived therefrom by a person skilled in the art without departing from the scope of protection of the invention.

LIST OF REFERENCE SIGNS

1 Roll stand
2, 15 Uncoiling reel
3, 7 Steel strips
4, 16, 19 Deflecting-roller pairs
5, 17 Straightening driver
6 Heating device
8 Movable platform
9 Head of the strip
10, 14 Shearing means
11 Hold-down roller
12 Loop lifter
13, 18 Driver devices
A, B Points

The invention claimed is:

1. A method for operating a cold rolling mill, comprising:

wherein a first steel strip and a second steel strip are rolled in at least one roll stand of the cold rolling mill, wherein there is a pause in rolling, in which no steel strip is rolled, between the rolling of the first steel strip and the rolling of the second steel strip;

wherein starting from a first uncoiling reel, the first steel strip is fed to the roll stand via a first path and is not heated while it is being fed to the roll stand;

wherein starting from the first uncoiling reel or a second uncoiling reel which is different than the first uncoiling reel, the second steel strip is fed to the roll stand via a second path and is heated while it is being fed to the roll stand; and wherein the second path is longer than the first path.

2. The operating method as claimed in claim 1, further comprising heating the second steel strip by means of an induction heater.

3. The operating method as claimed in claim 1, further comprising:

starting from the first or the second uncoiling reel, initially moving the second steel strip toward the roll stand, but the initial moving toward the roll stand is ended before a head of the second steel strip arrives at the roll stand;

then placing a heating device against the second steel strip, causing the heating device, as viewed in the transport direction of the second steel strip, to be located at a portion of the second steel strip that has already been uncoiled at this time, and only then continuing the moving of the second steel strip toward the roll stand, such that a head of the strip arrives at the roll stand and is taken up by the roll stand.

4. The operating method as claimed in claim 3, further comprising:

moving the second steel strip away from the roll stand between the placement of the heating device against the second steel strip and subsequently continuing the moving of the second steel strip toward the roll stand, wherein the head of the second steel strip stops at the outlet of the heating device.

5. A cold rolling mill, comprising:

a roll stand for rolling a first steel strip immediately after the first steel strip has been uncoiled from a first uncoiling reel;

and a second steel strip is rolled immediately after the second steel strip has been uncoiled from the first uncoiling reel or from a second uncoiling reel which is different than the first uncoiling reel;

starting from the first uncoiling reel, the cold rolling mill has a first path, via which, the first steel strip reel can be fed to the roll stand;

no heating device for heating the first steel strip is arranged in the first path, so that the first steel strip is fed to the roll stand at that temperature of the first steel strip at which the first steel strip is uncoiled from the first uncoiling reel;

the cold rolling mill has a second path, starting from the first or second uncoiling reel, the second steel strip can be fed to the roll stand;

a heating device for heating the second steel strip is arranged in the second path, so that the second steel strip is fed to the roll stand at a temperature which is higher than that temperature of the second steel strip at which the second steel strip is uncoiled from the first or second uncoiling reel; and the second path is longer than the first path.

6. The cold rolling mill as claimed in claim 5, further comprising:

the second steel strip is uncoiled from the first uncoiling reel;

the first uncoiling reel is arranged on a movable platform, and the platform can be positioned at least in a first position and a second position;

the first uncoiling reel is arranged closer to the roll stand in the first position of the platform than in the second position of the platform for causing the first path to extend from the first uncoiling reel to the roll stand while the platform is in the first position, and for causing the second path to extend from the first uncoiling reel to the roll stand while the platform is in the second position; and at least whenever the movable platform is in the second position, the heating device can be placed against the second steel strip parallel to the second steel strip, but transversely in relation to a transport direction of the second steel strip from the first uncoiling reel to the roll stand, or the heating device can be placed against the second steel strip orthogonally in relation to the second steel strip.

7. The cold rolling mill as claimed in claim 5, further comprising:

the second steel strip is uncoiled from the first uncoiling reel;

a loop lifter is arranged between the first uncoiling reel and the roll stand;

the first steel strip passes through the loop lifter without deflection in a first positioning of the loop lifter and the second steel strip passes through the loop lifter in a second positioning of the loop lifter to form a loop, whereby the first path extends from the first uncoiling reel to the roll stand without forming a loop and the second path extends from the first uncoiling reel to the roll stand with formation of the loop;

at least whenever the loop lifter is in the second position, the heating device can be placed against the second steel strip in the region of the loop parallel to the second steel strip, but transversely in relation to a transport direction of the second steel strip in the region of the loop.

8. The cold rolling mill as claimed in claim 5, further comprising:

the second steel strip is uncoiled from the second uncoiling reel;

a driver device is arranged upstream of the roll stand, such that the first path extends from the first uncoiling reel, via the driver device, to the roll stand and the second path extends from the second uncoiling reel, via the driver device, to the roll stand; and the heating device is arranged between the second uncoiling reel and the driver device.

9. The cold rolling mill as claimed in claim 8, further comprising:

the heating device can be placed against the second steel strip parallel to the second steel strip, but transversely in relation to a transport direction of the second steel strip from the second uncoiling reel to the driver device, or the heating device can be placed against the second steel strip orthogonally in relation to the second steel strip.

10. The cold rolling mill as claimed in claim 5, further comprising the heating device is in the form of an induction heater.

* * * * *